US011114804B2

(12) United States Patent
Zhang

(10) Patent No.: US 11,114,804 B2
(45) Date of Patent: Sep. 7, 2021

(54) SHIELDED-CABLE PASS-THROUGH ASSEMBLY WITH BOUNDRY CONTACT

(71) Applicant: Aptiv Technologies Limited, St. Michael (BB)

(72) Inventor: Anyang Zhang, Shanghai (CN)

(73) Assignee: APTIV TECHNOLOGIES LIMITED, Troy, MI (US)

( * ) Notice: Subject to any disclaimer, the term of this patent is extended or adjusted under 35 U.S.C. 154(b) by 36 days.

(21) Appl. No.: 16/473,387

(22) PCT Filed: Dec. 30, 2016

(86) PCT No.: PCT/CN2016/113566

§ 371 (c)(1),
(2) Date: Jun. 25, 2019

(87) PCT Pub. No.: WO2018/120045

PCT Pub. Date: Jul. 5, 2018

(65) Prior Publication Data

US 2020/0144771 A1 May 7, 2020

(51) Int. Cl.
*H01R 13/6592* (2011.01)
*H01R 13/6593* (2011.01)
*H01R 13/502* (2006.01)

(52) U.S. Cl.
CPC ..... *H01R 13/6593* (2013.01); *H01R 13/502* (2013.01)

(58) Field of Classification Search
CPC .. H01R 13/502; H01R 13/508; H01R 13/648; H01R 13/655; H01R 13/658;
(Continued)

(56) References Cited

U.S. PATENT DOCUMENTS 4,106,839 A * 8/1978 Cooper ..... H01R 13/6583 439/607.18
4,183,605 A * 1/1980 Arneson ..... H01R 13/622 439/311

(Continued)

FOREIGN PATENT DOCUMENTS

CN 201303150 Y 9/2009
CN 101950892 A 1/2011

(Continued)

OTHER PUBLICATIONS

CN 205231371 Translation. (Year: 2016).*
Second Chinese Office Action for CN Application No. 201680091950.7, 6 pages.

*Primary Examiner* — Renee S Luebke
*Assistant Examiner* — Milagros Jeancharles
(74) *Attorney, Agent, or Firm* — Robert Myers

(57) ABSTRACT

A shielded-cable pass-through assembly configured to provide electrical contact between a shielding-layer of a shielded-cable and a boundary through which the shielded-cable passes includes a metallic-sleeve and a contact-terminal. The metallic-sleeve defines a shield-surface used to make electrical contact with a shielding-layer of a shielded-cable. The contact-terminal defines a contact-feature used to make electrical contact with the boundary through which the shielded-cable passes. The contact-terminal also defines a plurality of inner-contact-fingers extending from the contact-terminal in a longitudinal-direction parallel to a longitudinal-axis of the shielded-cable. The plurality of inner-contact-fingers is urged in a radial-direction to make electrical contact with a contact-surface of the metallic-sleeve after the assembly is assembled.

12 Claims, 6 Drawing Sheets

(58) Field of Classification Search
CPC ..... H01R 13/6581; H01R 13/6583; H01R 13/6588; H01R 13/6591; H01R 13/6592; H01R 13/6593; H01R 13/6598
See application file for complete search history.

(56) References Cited

U.S. PATENT DOCUMENTS 4,377,320 A * 3/1983 Lathrop ..... H01R 24/40 439/585
4,408,816 A * 10/1983 Knecht ..... H01R 13/6592 439/470
4,488,765 A * 12/1984 Erbe ..... H01R 13/44 439/137
4,685,758 A * 8/1987 Yoshida ..... H01R 9/05 439/606
5,180,316 A * 1/1993 Miller ..... H01R 13/6592 439/247
6,019,615 A * 2/2000 Masuda ..... H01R 9/0518 174/653
6,042,396 A * 3/2000 Endo ..... H01R 9/0527 174/652
6,095,841 A 8/2000 Felps
6,280,208 B1 * 8/2001 Masuda ..... H01R 4/64 174/359
7,267,560 B2 * 9/2007 Akino ..... H04R 19/04 439/101
7,654,856 B2 2/2010 Wu
8,585,415 B2 11/2013 Marsh et al.
8,602,797 B2 * 12/2013 Omae ..... H01R 9/0518 439/99
9,653,823 B2 * 5/2017 Eriksen ..... H01R 9/0518
9,905,959 B2 * 2/2018 Burris ..... H01R 13/5205
2010/0112864 A1 5/2010 Huang et al.
2014/0235104 A1 8/2014 Wang

FOREIGN PATENT DOCUMENTS

CN 102341965 B 2/2012
CN 203690653 U 7/2014
CN 205231371 U 5/2016
CN 205646199 U 10/2016
WO 2014129417 A1 8/2014

* cited by examiner

SHIELDED-CABLE PASS-THROUGH ASSEMBLY WITH BOUNDRY CONTACT

CROSS REFERENCE TO RELATED APPLICATIONS

This application is a national stage application under 35 U.S.C. § 371 of PCT Application Number PCT/CN16/113566 having an international filing date of Dec. 30, 2016, which designated the United States, the entire disclosure of which is hereby incorporated herein by reference.

TECHNICAL FIELD OF INVENTION

This disclosure generally relates to a shielded cable pass through assembly, and more particularly relates to the interface between a metallic sleeve that makes electrical contact with a shielding layer of a shielded cable and a contact terminal that makes electrical contact with a boundary through which the shielded cable passes.

BACKGROUND OF INVENTION

It is sometimes desirable to provide electrical contact between a shielding layer of a shielded cable and a boundary through which the shielded cable passes. However, many of the proposed solutions are undesirably expensive and/or complex and/or unreliable.

SUMMARY OF THE INVENTION

In accordance with one embodiment, a shielded cable pass through assembly configured to provide electrical contact between a shielding layer of a shielded cable and a boundary through which the shielded cable passes is provided. The assembly includes a metallic sleeve and a contact terminal. The metallic sleeve defines a shield surface used to make electrical contact with a shielding layer of a shielded cable. The contact terminal defines a contact feature used to make electrical contact with the boundary through which the shielded cable passes. The contact terminal also defines a plurality of inner contact fingers extending from the contact terminal in a longitudinal direction parallel to a longitudinal axis of the shielded cable. The plurality of inner contact fingers is urged in a radial direction to make electrical contact with a contact surface of the metallic sleeve after the assembly is assembled.

Further features and advantages will appear more clearly on a reading of the following detailed description of the preferred embodiment, which is given by way of non-limiting example only and with reference to the accompanying drawings.

BRIEF DESCRIPTION OF DRAWINGS

The present invention will now be described, by way of example with reference to the accompanying drawings, in which.

DETAILED DESCRIPTION

Figure 1:
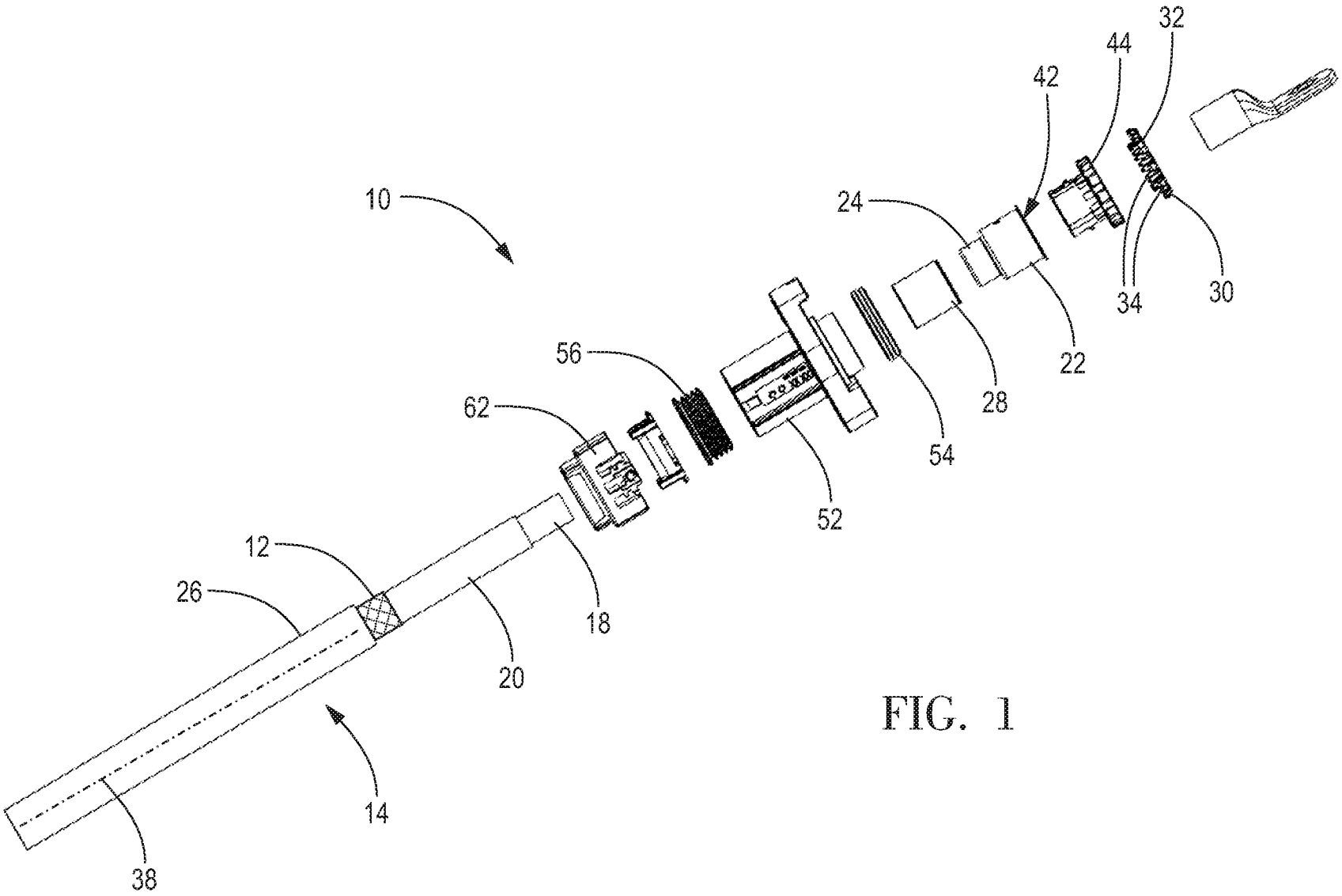
FIG. 1 is an exploded view of a shielded cable pass through assembly in accordance with one embodiment.
Figure 2:
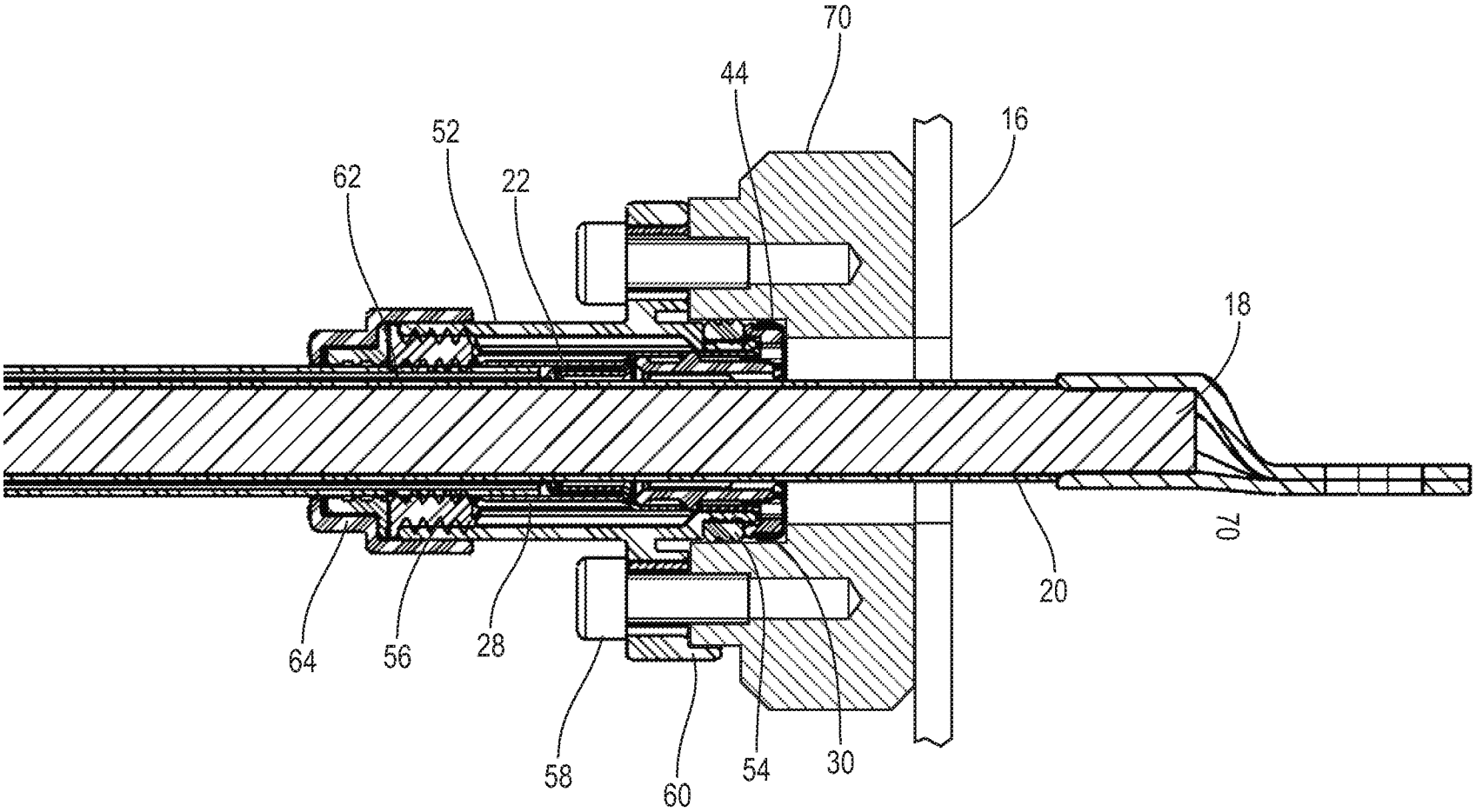
FIG. 2 is a sectional view of the shielded cable pass through assembly of FIG. 1 in accordance with one embodiment.

FIGS. 1 and 2 illustrate a non-limiting example of a shielded cable pass through assembly 10, hereafter referred to as the assembly 10, which is generally configured to provide electrical contact between a shielding layer 12 of a shielded cable 14 and a boundary 16 (FIG. 2) through which the shielded cable 14 passes. In this example the shielded cable 14 is illustrated as having a single conductor 18 covered or wrapped by an insulation layer 20, where the single conductor 18 may be sized to be suitable for conducting current from a battery (not shown) in an electric vehicle (not shown). However, the single conductor 18 is not a requirement as it is contemplated that multiple conductors may be covered by the insulation layer 20 with the shielding layer 12 providing electromagnetic protection to the multiple conductors. It is also contemplated that the features and parts of the assembly 10 could be duplicated in parallel to form a unitized 2-way, 3-way, or more-way assembly for multiple parallel instances of the single conductor 18. For reliability and durability reasons it is preferred that the shielding layer 12 be a braided wire type shielding. However, this is not a requirement as it is contemplated that the shielding layer 12 could be formed of metallic foil, with an optional single wire conductor, as will be recognized by those in the art.

The boundary 16 may be a metal body panel of a vehicle or enclosure for electrical equipment. The boundary 16 may include an interface 70 such as the interface which is shown by Marsh et al. in U.S. Pat. No. 8,585,415 issued Nov. 19, 2013, or corresponding Chinese Patent Number 102341965 issued Jul. 15, 2015; see reference number 118 in those documents. The interface 70 is preferably formed of metal and may be welded or otherwise attached to the boundary 16 in a manner that provides for an electrical connection between the interface 70 and the boundary 16. The assembly 10 may also include various seals, fixtures, and fasteners used to attach the assembly 10 to the interface or boundary 16.

The assembly 10 includes a metallic sleeve 22 that defines a shield surface 24 used to make electrical contact with the shielding layer 12 of a shielded cable 14. The shielded cable 14 may be prepared (i.e. stripped) as suggested in FIG. 1 by removing portions of the outer cover 26, the shielding layer 12, and the insulation layer 20. The portion of the metallic sleeve 22 that defines the shield surface 24 is typically sized to slide over the insulation layer 20 and underneath the shielding layer 12. The metallic sleeve 22 may be formed of brass, plated steel, or any other material suitable to make a reliable electrical connection with the shielding layer 12.

The assembly 10 may also include a ferrule 28 that is crimped over the shielding layer 12 around where the shielding layer 12 makes contact with the shield surface 24 of the metallic sleeve 22 to urge the shielding layer 12 of the shielded cable 14 into reliable electrical contact with the shield surface 24. Like the metallic sleeve 22, the ferrule 28 may be formed of brass, plated steel, or any other material suitable to crimp and thereby make a reliable electrical connection between with the shielding layer 12 and the shield surface 24.

Figure 3A:
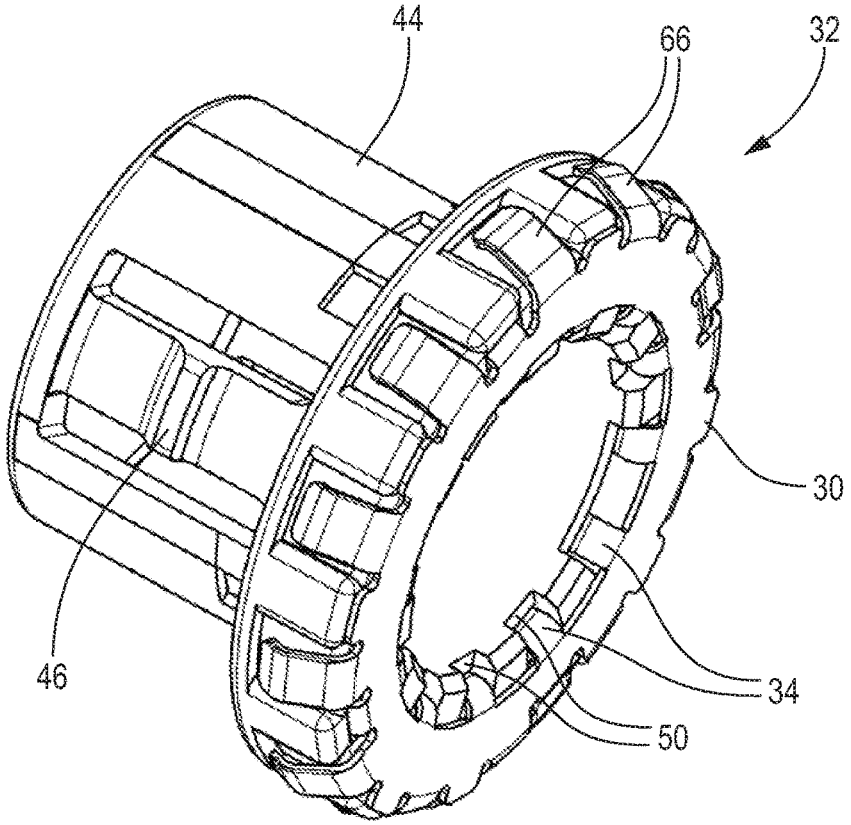
FIGS. 3A, 3B, and 3C are views of parts used to form the shielded cable pass through assembly of FIGS. 1 and 2 in accordance with one embodiment.
Figure 3B:
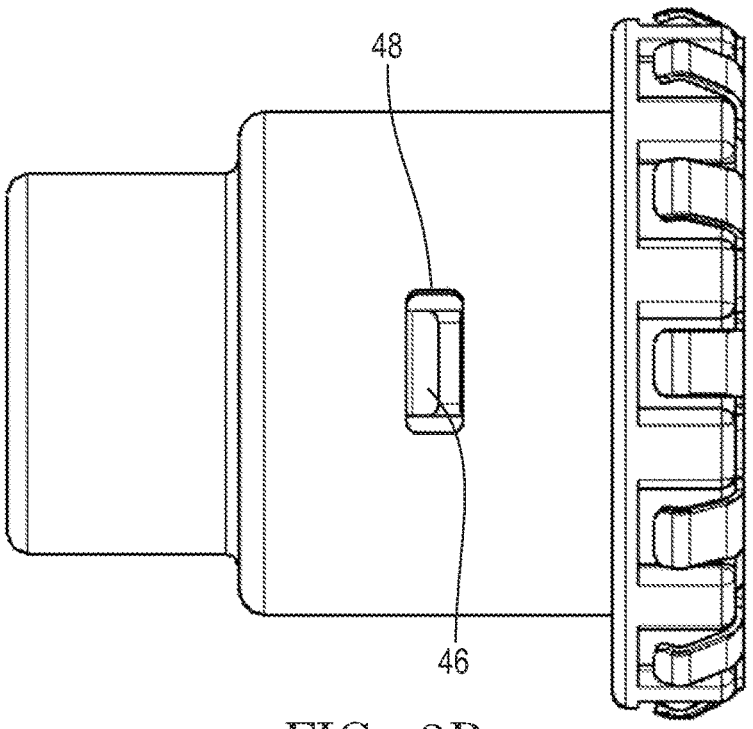
Figure 3C:
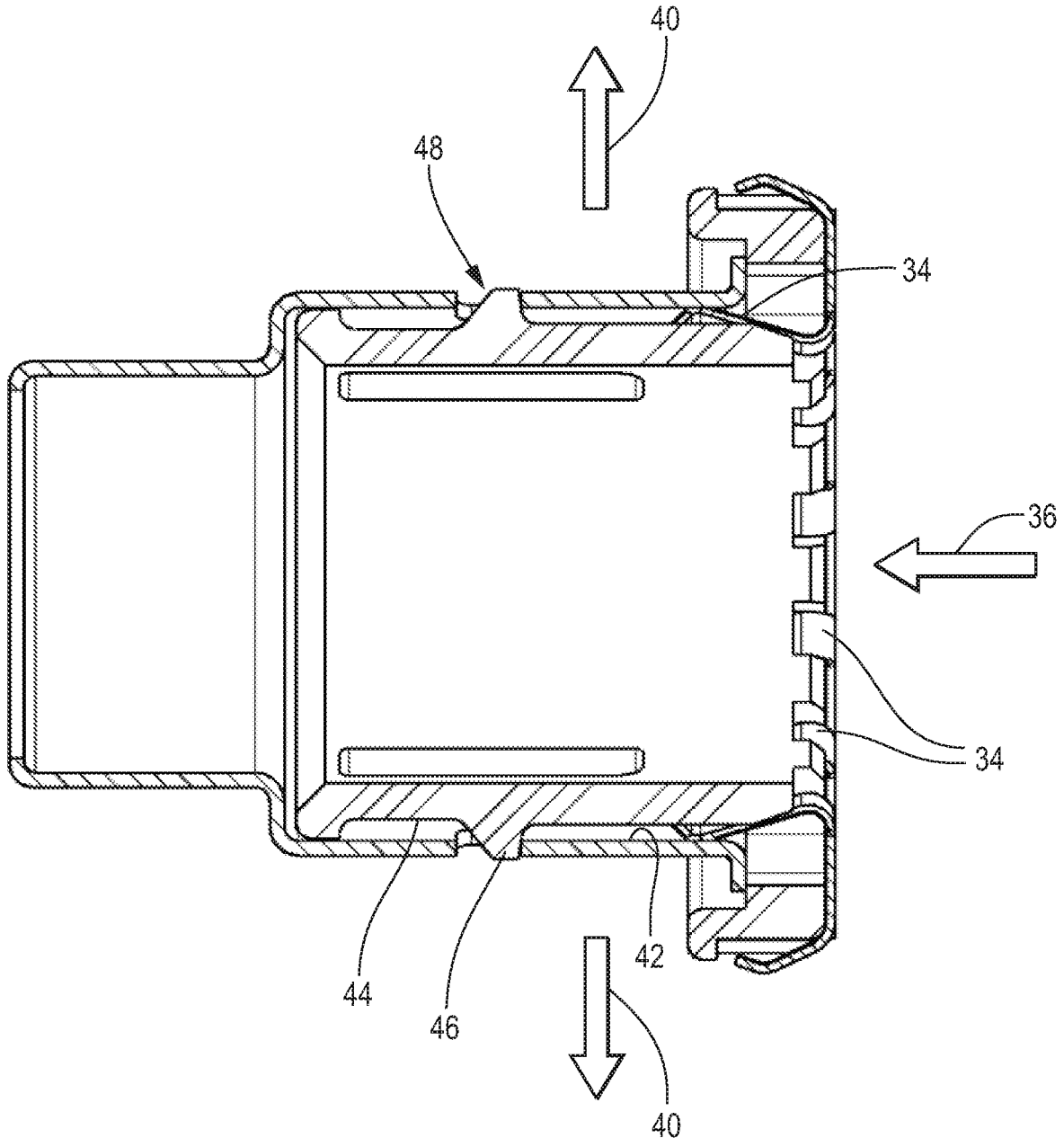
Figure 4:
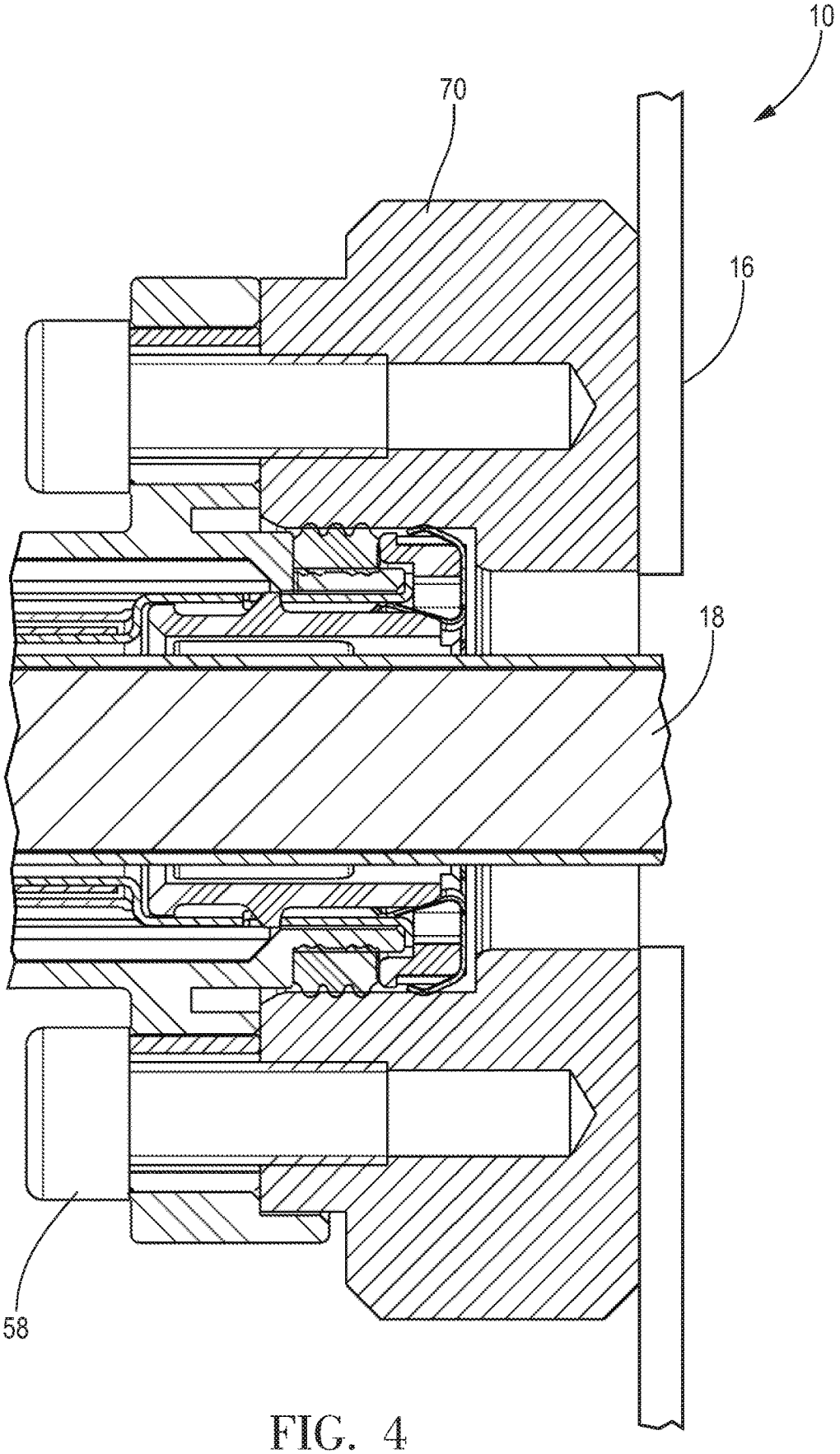
FIG. 4 is a close-up sectional side view of part of the assembly of FIG. 1.

The assembly 10 includes a contact terminal 30 that defines a contact feature 32 (FIG. 3A) that may be used to make electrical contact with the boundary 16 when the assembly 10 is attached to the boundary 16. The contact terminal 30 includes or defines a plurality of inner contact fingers 34 extending from the contact terminal 30 in a longitudinal direction 36 (FIG. 3C) parallel to a longitudinal axis 38 (FIG. 1) of the shielded cable 14. The material used to form the contact terminal 30 (e.g. beryllium copper) and the shape of the inner contact fingers cooperate so that the plurality of inner contact fingers 34 are urged in a radial direction 40 (FIG. 3C) to make electrical contact with a contact surface 42 of the metallic sleeve 22 after the assembly 10 is assembled. That is, the plurality of inner contact fingers 34 maintains a spring-loaded contact with the contact surface 42 once assembled. While the contact surface 42 is shown in this non limiting example as being on the inside of the metallic sleeve 22 so that the radial direction 40 is radially outward, this is not a requirement. It is contemplated that contact surface 42 could be on the outside of the metallic sleeve 22 and the plurality of inner contact fingers 34 could be configured to be urged or press against the metallic sleeve 22 from the outside in a radially inward direction.

Figure 5:
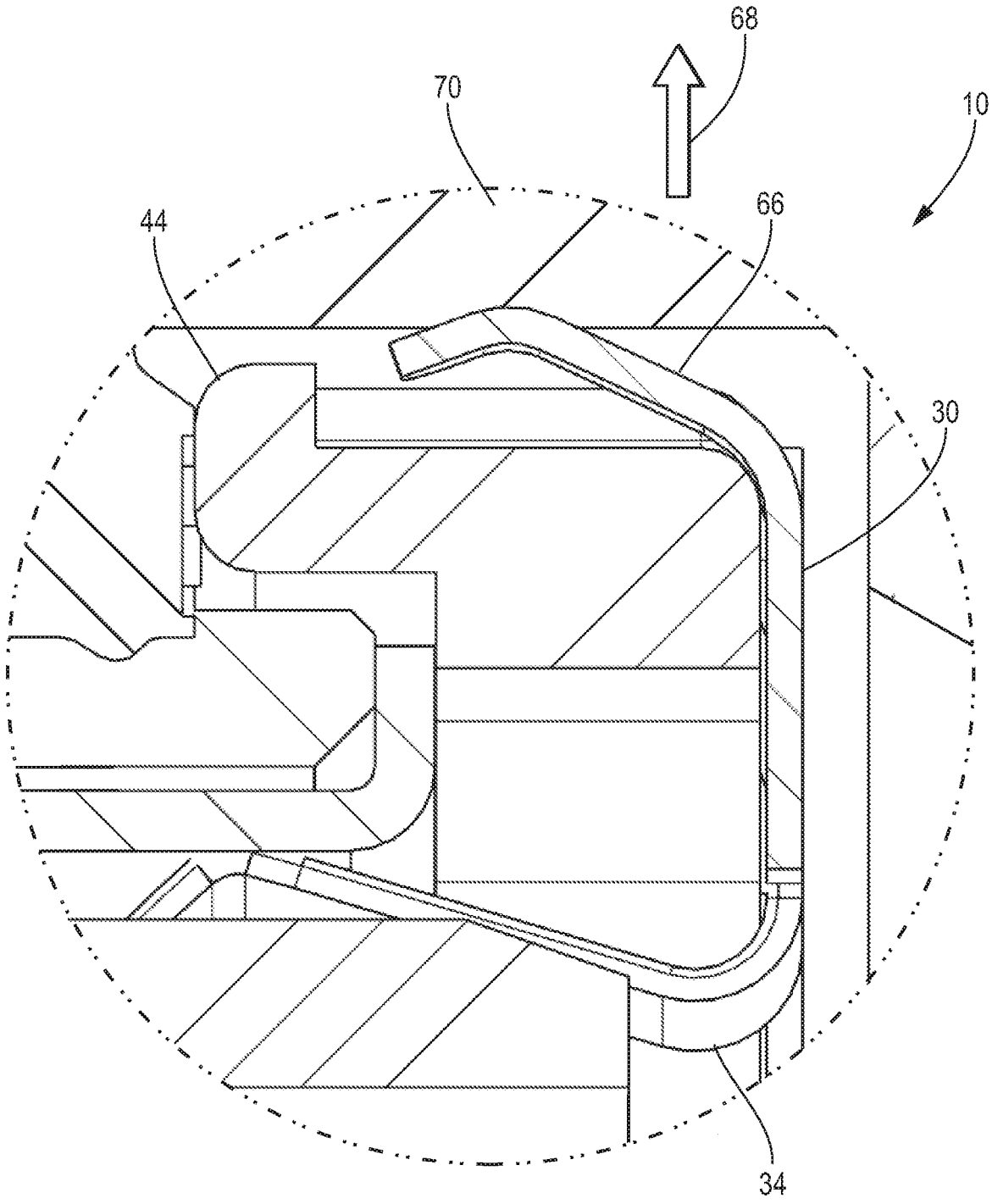
FIG. 5 is a close-up sectional side view of part of the assembly of FIG. 4.

The contact feature 32 or the contact terminal 30 may be further configured to define a plurality of outer contact fingers 66 that are urged in an other radial direction 68 (FIG. 5) to make electrical contact with the interface 70 after the assembly 10 is assembled. In this example the other radial direction 68 corresponds to the radial direction 40. However, similar to what was mentioned above, other configurations are envisioned where the other radial direction 68 is opposite to the radial direction 40, either in a radially inward direction or a radially outward direction.

The assembly 10 may include a retainer 44 that defines a tab or hook 46 that fits into an opening 48 defined by the metallic sleeve 22. The hook 46 and the opening 48 are configured to cooperate with each other to retain the metallic sleeve 22 on the retainer 44 and prevent rotation of the metallic sleeve 22 relative to the retainer 44 after the assembly 10 is assembled. The retainer 44 may also define a plurality of passageways 50 through which the plurality of inner contact fingers 34 passes after the assembly 10 is assembled, or at least the contact terminal 30 and the retainer 44 are assembled. The plurality of passageways 50 and the plurality of inner contact fingers 34 cooperate to prevent rotation of the contact terminal 30 relative to the retainer 44 after the assembly is assembled. The prevention of rotation of the various parts is advantageous as it helps to reduce wear of the various points of electrical contact used to form the electrical connection between the shielding layer 12 and the boundary 16.

The assembly 10 may include a housing 52 that cooperates with a peripheral seal 54 and a wire seal 56 to cover and protect from moisture and other contaminates the parts inside the housing that form the electrical connection between the shielding layer 12 and the boundary 16. The housing 52 may be further configured to support the shielded cable 14 and provide the necessary features 60 so fasteners 58 can be used to fix or attach the assembly 10 to the boundary 16. The assembly 10 may include a lock insert 62 that cooperates with a cover 64 to secure the wire seal 56 and provide strain relief for the shielded cable 14.

Accordingly, a shielded cable pass through assembly (the assembly 10) is provided that provides a convenient, economical, and reliable way to make an electrical contact between a shielding layer of a shielded cable and a boundary through which the shielded cable passes.

While this invention has been described in terms of the preferred embodiments thereof, it is not intended to be so limited, but rather only to the extent set forth in the claims that follow.

I claim:

1. A shielded cable pass through assembly configured to provide electrical contact between a shielding layer of a shielded cable and a boundary through which the shielded cable passes, said assembly comprising:

a metallic sleeve that defines a shield surface used to make electrical contact with the shielding layer of the shielded cable;

a contact terminal that defines a contact feature used to make electrical contact with the boundary through which the shielded cable passes, and defines a plurality of inner contact fingers extending from the contact terminal in a longitudinal direction parallel to a longitudinal axis of the shielded cable, wherein the plurality of inner contact fingers is urged in a radial direction to make electrical contact with a contact surface of the metallic sleeve after the assembly is assembled; and a retainer that defines a hook that fits into an opening defined by the metallic sleeve, wherein the hook and the opening cooperate to retain the metallic sleeve on the retainer and prevent rotation of the metallic sleeve relative to the retainer after the assembly is assembled.

2. The assembly in accordance with claim 1, wherein the boundary includes an interface and the contact terminal defines a plurality of outer contact fingers urged in another radial direction to make electrical contact with an interface after the assembly is assembled.

3. The assembly in accordance with claim 1, wherein the retainer defines a plurality of passageways through which the plurality of inner contact fingers passes after the assembly is assembled, wherein the plurality of passageways and the plurality of inner contact fingers cooperate to prevent rotation of the contact terminal relative to the retainer after the assembly is assembled.

4. The assembly in accordance with claim 1, wherein the assembly includes a ferrule that is crimped around the shield surface of the metallic sleeve to urge the shielding layer of the shielded cable into electrical contact with the shield surface.

5. The assembly in accordance with claim 1, wherein the retainer defines a plurality of passageways through which the plurality of inner contact fingers pass after the contact terminal and the retainer are assembled.

6. The assembly in accordance with claim 5, wherein the plurality of passageways and the plurality of inner contact fingers cooperate to prevent rotation of the contact terminal relative to the retainer after the assembly is assembled.

7. The assembly in accordance with claim 1, further comprising a ferrule crimped over the shielding layer around where the shielding layer makes contact with the shield-surface of the metallic sleeve and configured to urge the shielding layer of the shielded cable into electrical contact with the shield surface.

8. The assembly in accordance with claim 1, wherein the contact terminal is formed of a beryllium-copper material.

9. The assembly in accordance with claim 8, wherein the beryllium-copper material forming the contact terminal and a shape of the inner contact fingers cooperate so that the plurality of inner contact fingers are urged in a radial direction to make electrical contact with a contact surface of the metallic sleeve after the assembly is assembled.

10. The assembly in accordance with claim 1, wherein the boundary is a metal panel.

11. The assembly in accordance with claim 1, further comprising a housing that cooperates with a peripheral seal and a wire seal to cover and protect parts inside the housing that form an electrical connection between the shielding layer and the boundary from moisture and other contaminants.

12. The assembly in accordance with claim 11, wherein the housing is configured to support the shielded cable and provide features so fasteners can be used to fix or attach the assembly to the boundary.

* * * * *